United States Patent [19]

Amabili

[11] 4,207,991

[45] Jun. 17, 1980

[54] CAN TOP OPENING MEANS

[76] Inventor: Arnaldo Amabili, 7680 Dollier St., St. Leonard, Quebec, Canada

[21] Appl. No.: 22,045

[22] Filed: Mar. 19, 1979

[51] Int. Cl.[2] ..... B65D 41/32

[52] U.S. Cl. ..... 220/269; 220/336

[58] Field of Search ..... 220/268–273, 220/336

[56] References Cited

U.S. PATENT DOCUMENTS

| | | | |
|---|---|---|---|
| 3,813,000 | 5/1974 | Underwood | 220/269 |
| 3,970,212 | 7/1976 | Brown | 220/269 |
| 4,008,823 | 2/1977 | Tarro | 220/269 |

*Primary Examiner*—George T. Hall

*Attorney, Agent, or Firm*—McFadden, Fincham & Co.

[57] ABSTRACT

A closure system comprising an end wall, a line of weakening within the end wall defining a removable panel, a tab member overlying a portion of the end wall and panel and being secured thereto, such that a lifting movement of the tab member will cause tear initiation in the line of weakening defining the removable panel to permit removal of the same.

18 Claims, 26 Drawing Figures

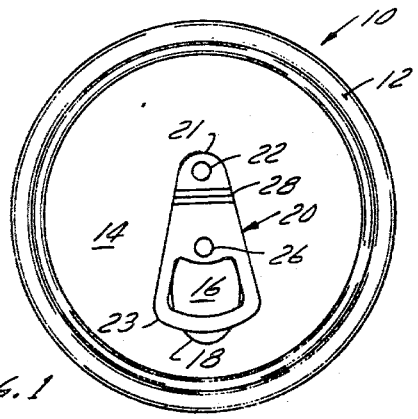
FIG. 1
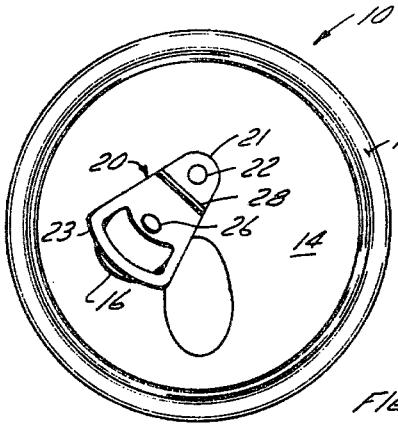
FIG. 2
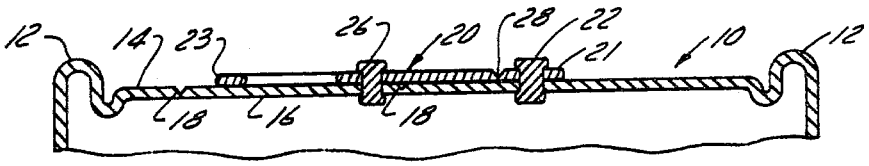
FIG. 3
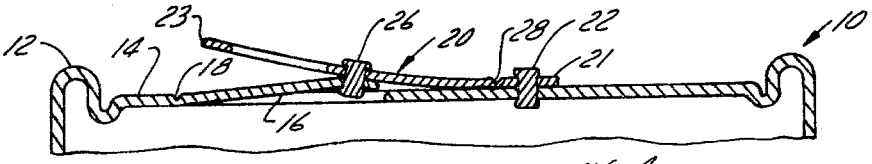
FIG. 4
FIG. 5
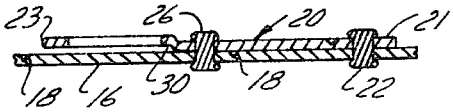
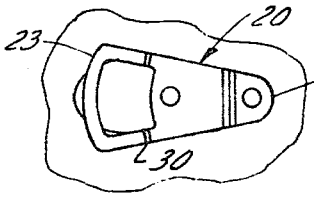
FIG. 6

CAN TOP OPENING MEANS

The present invention relates to a closure system for containers and more particularly, relates to easy-open containers having an end wall.

Many conventional containers and particularly metal cans used by the beverage industry are conventionally opened by the use of a tear strip which is removable from an end wall of the can with or without an attached tab. Following removal, the tear strips and tabs are frequently discarded by the public thus tending to create a litter problem as well as posing hazards in areas such as beaches and parks. As a result, several jurisdictions have banned or are considering banning the use of such metal tear strips.

In order to overcome the above problem, there have been various proposals in the art for the manufacture of containers wherein tear strips and/or tabs are secured nondetachably to the container. Such proposals have included the use of panels non-detachably secured to the end wall which are then subjected to an inward force whereby the panel is pushed inwardly but remains attached at one or more points to the can end. Such designs may be seen in, for example, Canadian Pat. Nos. 1,005,004 and 1,034,520, among others.

Although several of these designs have been commercially used, they still suffer from disadvantages; the primary disadvantage being that since the tab is pushed inwardly, the exterior surface of the panel contacts the contents of the container and any foreign contaminants on the exterior surface may be allowed to enter the container.

It is therefore an object of the present invention to provide an easy-open container of metallic material wherein any foreign contaminants on the end wall are substantially prevented from entering the container upon the opening thereof.

According to the present invention, there is provided a closure system comprising an end wall, a line of weakening within said end wall defining a removable panel, a tab member overlying a portion of said end wall and said removable panel, said tab member being secured to said end wall proximate one extremity of the tab member, a finger-engaging portion at an opposed extremity of said tab member, said tab member being secured to said removable panel proximate said line of weakening, whereby a lifting movement of the finger-engaging portion of said tab member will cause a tear initiation along said line of weakening to permit removal of said panel.

In greater detail, the closure or container end of the present invention may be employed with any suitable container such as generally found in the pop and beer can industry. In particular, the closure is particularly suitable for use with metallic cans of a steel or aluminum material.

The end wall of the closure is sealed on one end of the container in a conventional manner. In this respect, the securement of such end wall to the container per se is well known in the art and does not form a portion of the instant invention. The end wall may be formed of a suitable metallic material and generally, would be selected from suitable alloys of steel and/or aluminum material; the use of such materials being within the skill of those knowledgeable in the art.

In this regard, it is preferred that the closure or end be of the same material as the body of the container to permit ready recycling of the complete unit although it is also known in the art to employ separate materials with suitable provisions being made during the recycling process.

A dispensing aperture is formed in the end wall; this aperture is defined by a removable panel. In the preferred embodiment, the panel is defined by a line of weakening such as a score line. In other words, the panel is formed integrally with the end wall and is removable by means of a score line defining the dispensing aperture. The use of such weakening lines or score lines in this art field is well known and need not be elaborated on herein. It will be understood, however, that one may also employ a separate panel suitably secured to the end wall. This, however, is not preferred as an extra processing operation would be involved.

The tab member overlies a portion of the removable panel and the end wall. The tab member is secured to both the removable panel and the end wall. At one end or extremity of the tab there is provided a finer-engageable portion to permit a lifting movement of the tab.

Securement of the tab to the panel/end wall may be accomplished by suitable means such as the use of adhesives, and mechanical means. In the preferred embodiment of the invention, embossed rivets integral with the end wall and/or panel such as shown in Canadian Pat. No. 1,005,004 to Cudzik, issued Feb. 8, 1977, are employed. Preferably, the rivets forming the point of attachment between the removable panel and the tab is situated proximate to an edge of the removable panel for reasons which will become apparent hereinafter.

The tab member may be formed in several different manners and is preferably of a material compatible with the material forming the container body and the balance of the container system—i.e. the end wall. The tab may be of several different configurations although, as is conventional, a somewhat elongated shape is preferable. However, other configurations can be employed if so desired. The formation of an apropriate finger-engageable portion is well known in the art and need not be described herein. Similarly, the prevention of sharp edges and the use of reinforcing ribs is known in the art and need not be discussed herein. Still further, the use of suitable alloys and thicknesses are common knowledge in the field.

The tab member is adapted to be lifted at the finger-engageable end thereof such that a force is exerted on the attachment rivet forming the point of attachment between the tab and the removable portion causing a tear initiation along the line of weakening defining the removable panel. A continued lifting action on the finger-engageable portion will cause the panel to shear completely along the line of weakening relatively easily.

To aid in the above, the tab may be provided with one or more bend lines proximate its point of attachment to the end wall to permit easy bending of the tab thereabout.

Thus, the tab acts as a second class lever with the fulcrum of the lever, in the above embodiment, being the point of attachment of the tab to the end wall.

In order to provide maximum leverage, in one particular embodiment of the invention, the point of attachment of the tab to the end wall may be arranged such that the fulcrum is at a maximum distance from the finger-engageable portion. Although several different means may be employed to achieve the same result, in one preferred embodiment the tab may be folded back upon itself for a portion of its length such that the fold line or equivalent thereof is at a maximum distance from the first point of attachment to the removable panel. Furthermore, this arrangement permits one to arrange the point where the tab is attached to the end wall such that the panel, once lifted and pivoted to an out-of-the-way position, still remains within the boundaries of the end wall. In one particularly preferred embodiment, the fold line may be situated in the underneath portion of the folded back area as will be discussed hereinbelow.

Various embossings may be formed on the tab and/or removable panel and/or end wall for various purposes. Thus, embossings on the tab may serve the dual function of strengthening the tab while permitting one or more portions thereof to be slightly raised from the end wall permitting easier access to a finger-engaging portion thereof. Similar embossings may be provided on the end panel to provide rigidity such that once a tear initiation has been commenced, a continued tearing along the score line will be facilitated rather than a bending of the removable panel. Similarly, one or more embossed areas may be provided in the end wall about the removable panel to add rigidity to the area and, in addition, to keep the tab in a desired position.

In the preferred embodiments of the invention, the tab overlies the removable panel. The tab member has a major axis which may generally be defined as extending from the finger-engageable end thereof to the opposed end where it is secured to the end wall. The direction of motion or lifting of the tab is from the finger-engageable end to the rivetted end. Similarly, the removable panel usually has what may be considered to be a major axis extending from the attachment between the panel and tab (which is near the score line and thus a point one the periphery of the removable panel) to a point substantially "diametrically" opposite thereof. The preferred embodiments of the invention employ a teardrop or somewhat elliptically shaped removable panel giving a dispensing aperture of the same configuration. In this instance, the major axis is the longer axial length.

In particularly preferred embodiments of the invention, the major axis of the tab and the major axis of the removable panel are angled with respect to each other. The preferred angles are between 5° and 90° with particularly preferred angles being between 30° and 85°. However, the particular angle may be adjusted depending on various parameters associated with the particular closure system. Thus, an "ideal" angle of 180° wherein a lifting motion of the tab is transmitted initially directly to the attachment between the tab and the removable panel (such as in many conventional tear strips) could be the most desirable. However, conventional beer and pop cans are not of a size sufficient to permit use of such a large tab which would be required to obtain the required leverage. The opposite embodiment, wherein the finger-engageable end of the tab is at a minimum distance with respect to a point diametrically opposed to the attachment between the tab and removable panel is less desired than other embodiments, but is operable in many instances and in certain cases, may be desirable.

Having thus generally described the invention, reference will be made to the accompanying drawings illustrating an embodiment thereof, in which:

FIG. 1 is a top plan view of a container end embodying the closure of the present invention in a closed position;

FIG. 2 is a top plan view of the system of FIG. 1 after opening of the closure;

Figure 7:
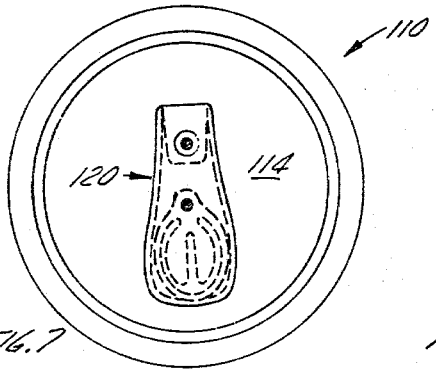
Figure 8:
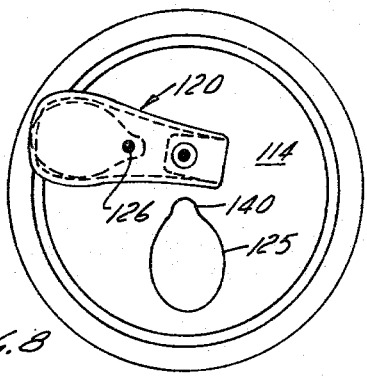
Figure 7A:
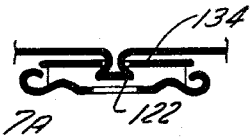
Figure 7B:
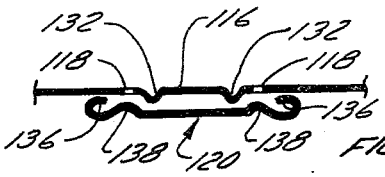
Figure 7C:
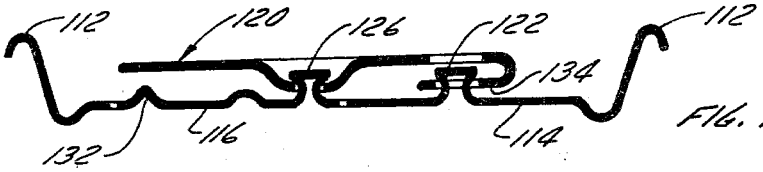
Figure 9:
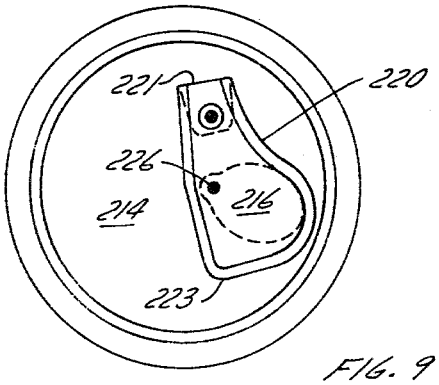
Figure 10:
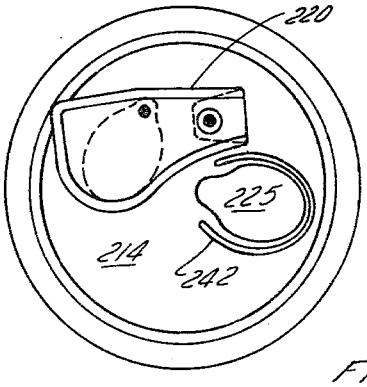
Figure 11:
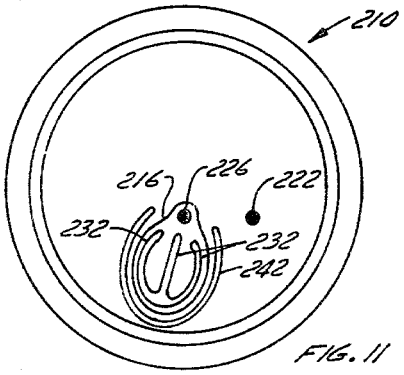
Figure 12A:
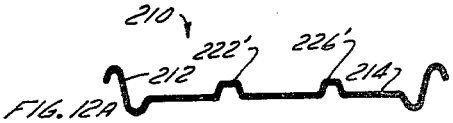
Figure 12B:
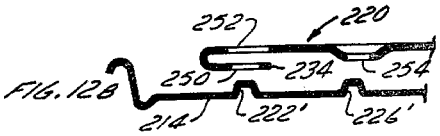
Figure 12C:
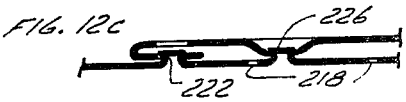
Figure 16:
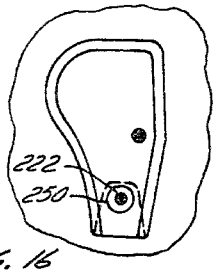
Figure 17:
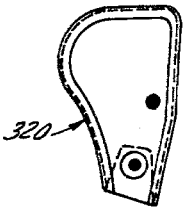
Figure 13:
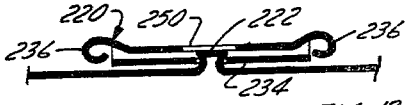
Figure 14:
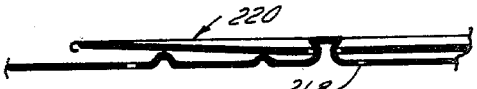
Figure 15:
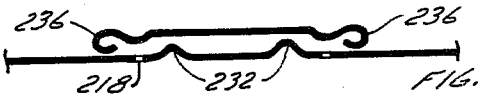
Figure 19:
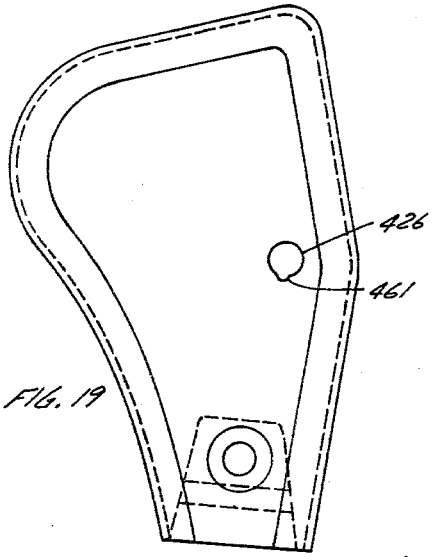
Figure 18:
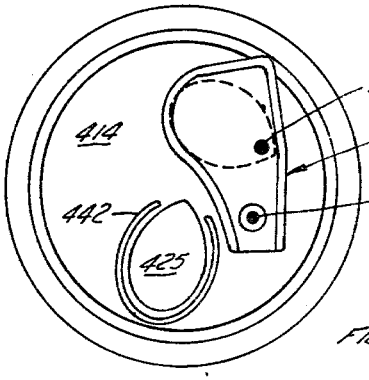
Figure 20:
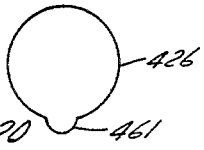
Figure 21:
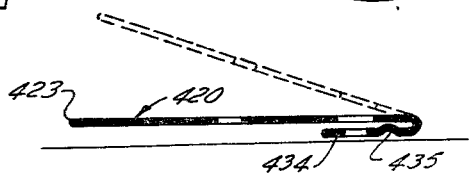

FIGl 3 is a side sectional view of the closure;

FIG. 4 is a view similar to FIG. 3 illstrating the opening of the closure system of the present invention;

FIG. 5 is a side sectional view of a modification to the closure system of FIG. 1;

FIG. 6 is a top plan view of a portion of the closure system of FIG. 6;

FIG. 7 is a top plan view of a modified closure system according to the present invention;

FIG. 7A is a partial sectional view through the point of attachment of the tab to the end wall;

FIG. 7B is a partial sectional view of the tab and removable panel;

FIG. 7C is a side sectional view along the longitudinal length of the tab and container end;

FIG. 8 is a view similar to FIG. 7 showing the closure system following opening thereof;

FIG. 9 is a top plan view of a further embodiment of the closure system;

FIG. 10 is a view similar to FIG. 9 showing the closure system following opening thereof;

FIG. 11 is a bottom view of the closure system of FIGS. 9 and 10;

FIGS. 12A, 12B and 12C are partial sectional views illustrating the securing of the tab member of the embodiment of FIGS. 9 to 11 to the end wall;

FIG. 13 is a partial sectional view taken along the lines A—A of FIG. 9;

FIG. 14 is a partial sectional view taken along the lines B—B of FIG. 9;

FIG. 15 is a partial sectional view taken along the lines C—C of FIG. 8;

FIG. 16 is a top plan view of the tab member of the closure system of FIG. 9;

FIG. 17 is a top plan view of a tab member similar to that shown in FIG. 16 with a modification thereto;

FIG. 18 is a top plan view of a further embodiment of a closure system according to the present invention;

FIG. 19 is a plan view of the tab member of FIG. 18;

FIG. 20 is a schematic view illustrating the securement of the tab member to the removable panel; and FIG. 21 is a side sectional view of the tab member of FIG. 19.

Referring to the drawings in greater detail and by reference characters thereto, the closure system illustrated includes a container end generally designated by reference numeral 10.

Container end 10 includes a rim 12 surrounding end wall 14 adapted to seat on the end of a cylindrical can in a conventional manner. End 10 may be sealed on the container by conventional means.

Within end wall 14 is a removable panel generally designated by reference numeral 16. Panel 16 is defined by a score line 18; the shape of panel 16 may be any desired although a generally elliptical or oval shaped panel to give a dispensing aperture of the same configuration is preferred for reasons well known to those skilled in the art. As may be seen, panel 16 is integral with and formed of the same material as end wall 14 and is defined by means of score line 18.

Lying adjacent to an exterior surface of end wall 14 is a tab member generally designated by reference numeral 20. As may be seen from FIGS. 3 and 4, one end or extremity 21 of tab member 20 is secured to end wall 14 by means of a rivet 22. At the other end (generally designated by numeral 23) of tab 20 there is provided a finger-engaging portion which has an aperture therein permitting the user to more easily grasp this end of tab member 20. Intermediate the finger-engaging portion 23, which overlies panel 16, and end 21 secured to wall 14 by rivet 22, is a further rivet 26 securing tab member 20 to a portion of panel 16. It will be noted that rivet 26 is situated proximate a portion of score line 18.

Tab 20 is provided with one or more "bend lines" 28 near rivet 22 to permit an easy bending of tab member 20 thereat.

In operation, end 23 is grasped and lifted or raised upwardly as shown in FIG. 4. This force is transmitted through rivet 26 to panel 16, and due to the proximity of rivet 26 to score line 18, a tear initiation begins. A continued lifting/pulling force exerted on tab 20 causes panel 16 to shear along score line 18 and completely detach panel 16 from end wall 14. Subsequently, tab 20 with attached panel 16 may be pivoted about rivet 22 to an out-of-the-way position as shown in FIG. 2. Thus, tab 20 functions as a second class lever with the fulcrum being rivet 22.

As shown in FIGS. 5 and 6, tab 20 may be provided with a raised portion near end 23 by means of an embossed ridge 30. Other equivalent means may be used as will be shown in greater detail hereinafter.

Referring to FIGS. 7 and 8, a further embodiment of a closure system according to the present invention is illustrated. More appropriate, similar reference numerals for components similar to those employed for the embodiments of FIGS. 1 through 6 are used, but numbered in the 100's.

As may be seen from FIGS. 7, 7A, 7B, 7C and 8, container end 110 is similar to the container end previously described in that end wall 114 has a removable panel 116 therein defined by a score line 118. A tab member 120 overlies panel 116.

In this particular embodiment, it will be noted that panel 116 is provided with embossing 132 thereon. Embossing 132 extends generally in the direction of the major axis of the panel 116. Embossing 132 adds strength and rigidity to the panel such that upon removal thereof, the panel tends to stay relatively rigid and does not bend.

Tab member 120 is of a somewhat different configuration than that illustrated in the embodiment of FIGS. 1 through 6. In the instant embodiment, tab member 120 is secured to end wall 14 by means of a "folded back" portion generally designated by reference numeral 134. Thus, folded back portion 134 is of a small length and is secured to end wall 114 by means of an embossed rivet 122. Embossed rivet 122 is formed in a manner which will be discussed hereinbelow with respect to FIGS. 12A to 12C. By securing tab member 120 to end wall 114 by means or portion 134, the effective length of the tab which is free to function as a lever is increased for a given size of can top available. Thus, tab 120 will bend about its hinge area between the main body portion thereof and portion 134.

In ordder to add rigidity to tab member 120, the longitudinal edges 136 may be folded under the main body portion as shown in FIG. 7B. In addition, one or more embossings such as indicated by reference numeral 138 may be employed.

In this particular embodiment, it will be noted that aperture 125 is formed by removal of panel 116 as a "teardrop" shape with a small irregularity 140 at the smaller end thereof to receive rivet 126 (similar to rivet 122) securing tab 120 to removable panel 116. This particular configuration provides good tear initiation.

Referring to FIGS. 9 and 10, wherein similar reference numerals in the 200's are employed to designate similar components described in previous embodiments, it will be seen that end wall 214 has a removable panel 216 (shown in dotted lines) defined therein by means of an appropriate score line. Tab 220 is similar to that of the embodiments of FIGS. 7 and 8 in that a folded under portion is provided and embossed rivets may be employed to secure the turned under portion to the end wall 214 and to secure tab member 220 to removable panel 216. However, in the illustrated embodiment, it will be noted that removable panel 216 is situated such that its major axial length (extending from an end proximate rivet 226 to a point diametrically opposite) is angled with respect to the tear direction of tab 220—i.e. extending from finger-engageable end 223 to end 221.

The above arrangement presents advantages in that once tear initiation has begun along the score line proximate rivet 226, a smaller force is required to continue the tear initiation as an upward force is applied to end 223 of tab 220.

In the illustrated embodiment, it will be noted that tab 220 is a continuous solid member without being provided with an aperture. If desired, an arrangement such as shown in FIGS. 1 through 6 may be employed. Tab 220 does, however, completely cover removable panel 216.

If desired, and as shown in FIG. 10, an embossing 242 may be provided about aperture 225 to strengthen the immediate area around the aperture. Also, as shown in FIG. 11, embossings 232 may be provided in removable panel 216 in a manner similar to the embodiments of FIGS. 7 and 8. Referring to FIGS. 12A, 12B and 12C, there is illustrated the formation of embossed rivets and the use of the same for securement of the tab to the container end. Thus, initially end 210 consisting of rim portion 212 and end wall 214 has embossed therein a pair of upstanding dome portions 222' and 226'. Tab member 220, as shown in FIG. 12B, has in bent back portion 234 an aperture 250 sized to receive dome portion 222'. In the main body portion of tab 220, and situated above aperture 250, is a slightly larger aperture 252. Also in the main body portion of tab 220 is a second aperture 254 which is situated above dome 226'. In this respect, it will be noted that the portion of tab 220 immediately surrounding aperture 254 is downwardly embossed as shown in FIG. 12B.

After tab 220 is placed on container end 210 with apertures 250 and 254 receiving dome portions 222' and 226' respectively, a subsequent operation "squashes" dome portions 222' and 226' as shown in FIG. 12C to form the finished rivets 222 and 226. Thus, dome portion 222' is squashed to seat on portion 234 of tab 220 by means of a suitable tool inserted through aperture 252. Dome portion 226' is squashed to fit within the downwardly embossed portion of tab 220 about aperture 254.

As shown in FIGS. 13, 14 and 15, the use of embossing and turned-under edges eliminates sharp corners and provides rigidity to the various structures involved.

Turning to FIG. 17, it will be seen that a further tab member 320 may advantageously be used in the previously described embodiment. In this tab member it will be noted that the hinge area is at an angle compared to the hinge area of FIG. 16. Thus, the fold line between the upper major portion of the tab and the lower bent back portion is at an angle with respect to the major axis of the tab. This arrangement, when employed in conjunction with the configuration shown in FIGS. 9 et seq, permits easier lifting of the tab during removal of the panel. Thus, the tab can "move" slightly in the direction in which the tearing of the panel is proceeding.

Referring to FIGS. 18 through 21, a still further modified closure system is illustrated with reference numerals in the 400's designating components similar to those previously designated by like reference numerals. As shown in FIG. 18, following removal of the removable panel, dispensing aperture 425 has an embossing 442 thereabout. It will be noted that the arrangement, as in previous embodiments, is such that tab 420 may be rotated or pivoted about rivet 422 while remaining within the boundaries of end wall 414.

Rivet 426 securing tab 420 to the removable panel, in the embodiment illustrated, is formed so as to have a slight projection 461. This projection 461 is formed by a suitable embossing to join the embossing operation and is adapted to prevent relative rotation of tab 420 and the removable panel secured thereto.

As shown in FIG. 21, the closure system may have end 423 of tab 420 slightly tapered upwardly to provide a better grip on the finger-engageable portion. In addition, the bend line 435 may be provided in bend back portion 434 as illustrated in FIG. 21. This bend line 435 permits, when the tab is lifted as illustrated in dotted lines, to bend thereabout. The bending about bend line 435 can be advantageous in that an increasing resistance would be provided to upward movement of the tab preventing the bending of the tab through 180°. Following a pivoting or rotation movement of the tab and attached panel, the tab would tend to revert back to its substantially lay-flat position.

The dimensions chosen for the tab and removable panel may vary depending on the various parameters involved—i.e. material, thickness, type of weakening line, etc. Those skilled in the art can readily make the necessary adjustments. In one particular preferred embodiment employing "conventional" can sizes having a diameter of between 2¼" and 2½", the removable panel is of a generally teardrop shape with a major axis length of between about ¾" to about 1" and preferably about ⅞" and a width (across the widest part) of between about 9/16" to about ¾" and preferably between 9/16" and 11/16". The width across the widest part is generally between ¼" to ½" and preferably about ⅜" from the nearest end of the major axis. The tab is sized to cover the panel and in an embodiment such as illustrated in FIGS. 9 to 16, the rivets may typically be spaced apart by approximately ½" with the tab having an overall length of about 1½" with the rivet secured to the panel being equidistant from either end of the tab. Naturally, changes may be made depending on the particular situation.

In a still further embodiment of the invention, the tab member may be designed to act in a self-limiting manner to prevent the same from being lifted to too large a degree. To this end, a tab member similar to that shown, for example, in Canadian Pat. No. 1,034,520 may be used. In this embodiment, the tab member is in substantially one plane with the fulcrum point being arranged with a score line or cut line thereabout. The tab member is a rigid one and the portion of the tab member from the fulcrum to the end of it limits the lifting movement by its engagement with the end wall. In essence, this embodiment would be similar to that shown in FIGS. 1 through 5 with the exception that there are no bend lines such as those designated by reference numeral 28 and furthermore, a U-shaped or equivalent cut is made about rivet 22.

It will be understood that the above-described embodiments are for the purposes of illustration only and that changes and modifications may be made thereto without departing from the spirit and scope of the invention. Thus, many conventional expedients known to those in this art may be employed in combination with the novel features of the above-described closure system.

I claim:

1. A closure system comprising an end wall, a line of weakening within said end wall defining a removable panel, a tab member overlying a portion of said end wall and said removable panel, said tab member being secured to said end wall proximate one extremity thereof, a finger-engaging portion at an opposed extremity of said tab member, said tab being secured to said removable panel proximate said line of weakening, whereby a lifting movement of the finger-engaging portion will cause said tab member to function as a second class lever and start a tear initiation along said line of weakening of said panel to permit removal of said panel.

2. The system of claim 1 wherein said tab is secured to said removable panel and said end wall by means of rivets.

3. The system of claim 2 wherein said rivets are embossed rivets formed integrally with said removable panel and said end wall.

4. The system of claim 3 wherein said removable panel and said tab each have a slightly elongated configuration.

5. The system of claim 2 wherein said line of weakening comprises a score line.

6. The system of claim 5 wherein said end wall, said removable panel, and said tab member are each of an aluminum material.

7. The system of claim 5 further including at least one bend line in said tab member about which said tab bends when said lifting movement is applied to the finger-engaging portion of said tab member.

8. The system of claim 2 wherein the extremity of said tab member secured to said end wall is folded back under a remaining portion of said tab whereby when the lifting movement is applied to said tab, the fulcrum of the lever is at the point where said tab is folded back.

9. The system of claim 1 wherein said tab member has a major axis extending from said finger-engaging portion to the fulcrum of the tab, said removable panel having a major axis extending from the point of securement of the panel to said tab to an opposed end of the removable panel, the major axis of the tab and the major axis of the removable panel forming an angle of mutual intersection of between 5° and 90°.

10. The system of claim 9 wherein said major axes intersect at an angle of between 35° and 85°.

11. The system of claim 9 wherein said tab member overlies all of said removable panel, said tab member lying within the periphery of said end wall.

12. The system of claim 9 wherein each of said tab and said panel have embossed portions thereon.

13. The closure system for use with a container, comprising an end wall, a score-line within said end wall defining a removable panel, a tab member overlying at least a portion of each of said end wall and said removable panel, said tab member having a configuration with a major axis and a minor axis, said removable panel having a configuration with a major axis and a minor axis, said tab member being secured to said end wall at one end of the major axis thereof and being secured to said removable panel proximate said score line, the major axis of the removable panel and the major axis of the tab member intersecting to form an angle of between 5 and 90 degrees.

14. The system of claim 13 wherein said axes form an angle of between 35° and 85°.

15. The system of claim 14 wherein said tab member completely overlies said removable panel.

16. The system of claim 15 wherein said end wall is substantially circular in configuration, said removable panel has a tear drop configuration with the major axis thereof lying along a diametrical cord of the end wall, the larger extremity of said removable panel being situated proximate the periphery of the end wall, and said tab member being secured to said removable panel proximate an opposed extremity thereof along said major axis, whereby a lifting movement of the tab member will cause said tab member to function as a second class lever starting a tear initiation at said opposed extremity along said line of weakening to permit removal of said panel.

17. A closure system for use with metallic beverage containers, said system consisting essentially of an end wall adapted to be secured to the container, a score line within said end wall defining a removable panel, a tab member overlying all of said removable panel and a portion of said end wall, said tab member lying within the periphery of the end wall, said tab member being secured to said end wall proximate one extremity of the tab, a finger-engaging portion at an opposed extremity of said tab member, said tab being secured to said removable panel proximate said line of weakening such that a lifting movement applied to the finger-engaging portion will cause said tab member to function as a second class lever and start a tear initiation along said line of weakening to permit removal of said panel.

18. The system of claim 17 wherein said tab has a major axis generally a line between said finger-engaging portion and said one extremity, said removable panel having a substantial oval configuration with the tab member being secured to the removable panel proximate one end of its major axis located interiorly of the periphery of the end wall, the major axis of the tab and the major axis of the removable panel intersected at an angle of between 5° and 90°.

* * * * *